United States Patent [19]

Granetzke

[11] 4,095,646

[45] Jun. 20, 1978

[54] HEAT EXCHANGE STRUCTURE

[75] Inventor: Dennis C. Granetzke, Racine, Wis.

[73] Assignee: Modine Manufacturing Company, Racine, Wis.

[21] Appl. No.: 758,129

[22] Filed: Jan. 10, 1977

[51] Int. Cl.[2] ..... F28F 7/00

[52] U.S. Cl. ..... 165/77; 165/95; 165/166

[58] Field of Search ..... 165/77, 78, 76, 95, 165/166

[56] References Cited

U.S. PATENT DOCUMENTS

| | | | |
|---|---|---|---|
| 852,140 | 4/1907 | Sadtler | 165/76 |
| 1,777,148 | 9/1930 | Owen | 165/75 |
| 2,179,721 | 11/1939 | Hock et al. | 165/78 |
| 2,623,735 | 12/1952 | Schofield et al. | 165/78 |
| 2,987,382 | 6/1961 | Endter et al. | 165/76 |

*Primary Examiner*—Albert W. Davis, Jr.

*Attorney, Agent, or Firm*—Wegner, Stellman, McCord, Wiles & Wood

[57] ABSTRACT

A heat exchanger structure including a rectangular heat exchanger with transverse passages for exchanging heat between at least two heat exchange fluids and a supporting frame with open sides, top and bottom for engaging the corresponding edge portions of the heat exchanger through a sealing gasket means for both supporting the heat exchanger and sealing the fluid passages for the heat exchange fluid from each other. A top of the frame is hinged and is clamped to an opposite side of the frame with releasable clamps so as to apply pressure to the heat exchanger through sealing gaskets but with the top being readily released when access to the heat exchanger is desired as for cleaning. The hinged top is provided with a projecting lever adjacent to the hinge so that as the hinged top is moved away from the heat exchanger it breaks the seal automatically at the gaskets for aid in servicing the heat exchanger.

10 Claims, 3 Drawing Figures

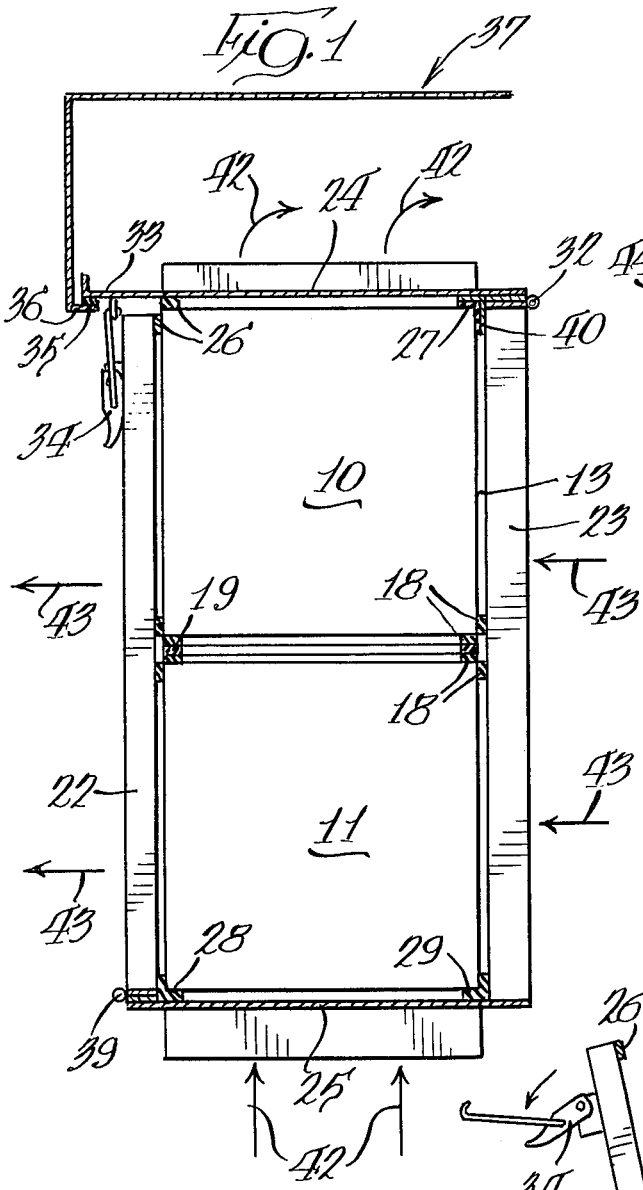
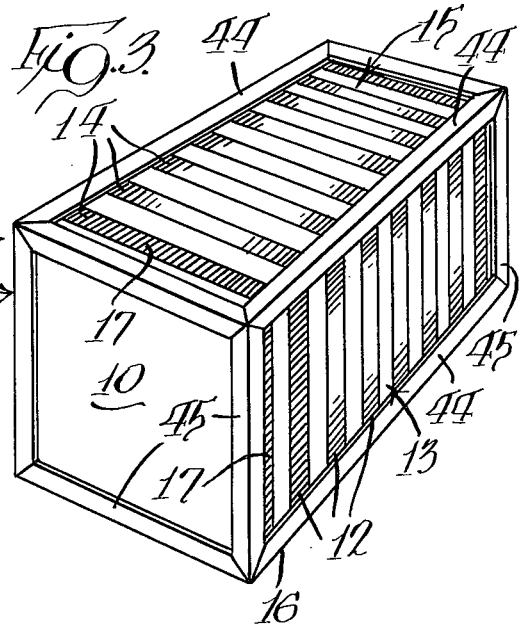
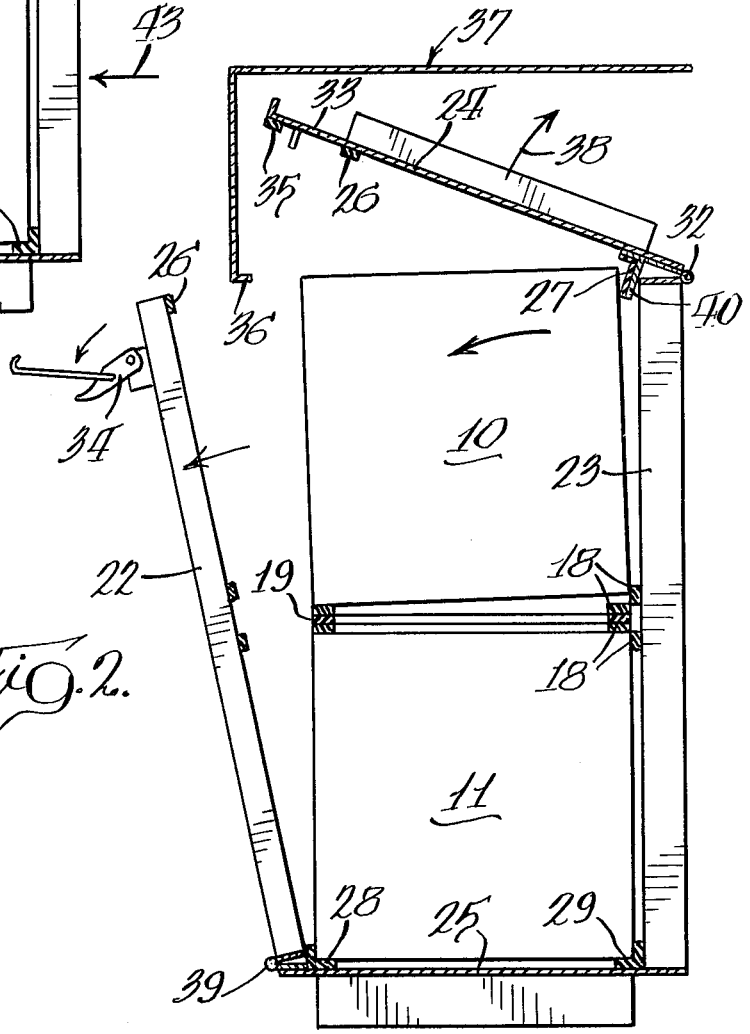
Fig. 2.

HEAT EXCHANGE STRUCTURE

SUMMARY OF THE INVENTION

One of the features of this invention is to provide a heat exchanger structure including a rectangular heat exchanger with transverse passages for separate heat exchange fluids and a supporting frame that is open to provide access to the fluid passages and one side of the frame being hinged with clamp means opposite to the hinge for moving this side away from the heat exchanger to provide access thereto.

Other features and advantages will be apparent from the following description of two embodiments thereof.

BRIEF DESCRIPTION OF THE DRAWINGS

FIG. 1 is a fragmentary sectional view through one embodiment of the heat exchanger structure of this invention.

FIG. 2 is a view similar to FIG. 1 but with the supporting frame parts open for removal of the heat exchanger.

FIG. 3 is a perspective view of a heat exchanger forming an element of the structure of this invention but illustrating a second embodiment of the sealing gasket arrangement.

DESCRIPTION OF THE PREFERRED EMBODIMENTS

In the structure of FIGS. 1 and 2 there are provided a pair of stacked heat exchangers 10 and 11 having the passage and fin arrangement illustrated in the embodiment of FIG. 3. In this heat exchanger, as is customary in this art, there are spaced parallel passages 12 extending from one side 13 of the exchanger to the opposite side 44. These passages 12 are in parallel for parallel flow of a heat exchange fluid such as heated gas or air therethrough. Arranged between each adjacent pair of passages 12 is another set of passages 14 extending from another side 15 of the heat exchanger to the opposite side 16. In the disclosed embodiment the sides 13 and 44 are the lateral sides while 15 and 16 are the top and bottom, respectively.

Each of these passages 12 and 14 which extend at right angles to each other is provided with a serpentine fin 17 as is customary in this art.

In the embodiment of FIGS. 1 and 2 there are provided a pair of the heat exchangers 10 and 11 arranged in a vertical stack and sealed at the corners by corner gaskets 18. The adjacent heat exchangers 10 and 11 are also sealed to each other by gaskets 19.

Each heat exchanger 10 and 11 may, if desired, be provided with handles 20 and 21 for convenience in moving the heat exchangers to and from their passages within the supporting framework.

The stacked exchangers 10 and 11 are releasably held in a supporting frame having open sides 22, 23, 24 and 25. In this embodiment the sides 22 and 23 are lateral sides while 24 is the top and 25 is the bottom. The top and bottom 24 and 25 are also provided with edge sealing gaskets 26, 27, 28 and 29. The gaskets 26 and 27 seal the top edges of the upper heat exchanger 10 to the top 24 of the frame while the gaskets 28 and 29 seal the bottom edges of the bottom heat exchanger 11 to the frame bottom 25.

The top 24 of the frame is hinged at one side by a pair of spaced hinges 32 of which only one is shown. The opposite edge 33 of the top 24 is latched by a readily releasable toggle latch 34 comprising a latch means that simultaneously holds the top 24 of the frame down against the sealing gaskets 26 and 27 and applies sealing pressure to the bottom gaskets 28 and 29 but also seals the outermost edge of the edge 33 through a gasket 35 down against the top surface of a flange 36 that forms a portion of an adjacent duct 37.

The open top 24 of the frame is provided with a downwardly extending rigid flange 37 that is located adjacent to the hinge means 32 to form an angle with the frame top 24. This flange 37 is between the side 13 of the top heat exchanger 10 and the adjacent open frame side 23. With this structure when the latch 34 is released as shown in FIG. 2 the frame top 24 rotates outwardly as indicated by the arrow 38 and the flange 37 acts as a second cross lever to break the seals between the gaskets and the heat exchangers so that the exchangers 10 and 11 may be easily removed for servicing such as cleaning.

In order to make this removal even simpler, the opposite lateral side 22 of the supporting frame is hinged at the bottom by spaced hinges 39 which may be similar to the hinges 32.

When the structure is in assembled position as shown in FIG. 1 a first heat exchange fluid 42 is passed upwardly through the passages 17 in the stacked heat exchangers 10 and 11 and into the upper duct 37 as indicated by the arrows. At the same time a second heat exchange fluid 43 passes through the passages 12 that extend between the lateral sides of the heat exchanger as indicated by the arrows in FIG. 1. Then when it is desired to remove the heat exchangers 10 and 11 as for servicing such as cleaning and replacement it is only necessary to release the toggle latches 34, of which two are usually used, turn the frame top 24 upwardly about its hinges 32 and turn the hinged lateral side 32 outwardly around its hinges 39 to break the seals by operation of the rigid flange 37 and simultaneously expose the heat exchangers 10 and 11 for servicing and replacement.

In the embodiment of FIG. 3 edge seals 44 and 45 are provided that are attached to the heat exchangers themselves.

Having described my invention as related to the embodiments disclosed in the accompanying drawings, it is my intention that the invention be not limited by any of the details of description, unless otherwise specified, but rather be construed broadly within its spirit and scope as set out in the appended claims.

I claim:

1. A heat exchanger structure, comprising: a rectangular heat exchanger having opposite sides including a top and bottom; a supporting frame enclosing said heat exchanger having open sides including an open top side and bottom side and open lateral sides; hinge means at one end of said frame sides for opening outwardly of the heat exchanger top side; gasket means sealing the edges of the heat exchanger to adjacent edges of said frame; and releasable clamp means drawing one of said frame sides toward the heat exchanger for releasably clamping all said frame sides to said frame at said gaskets.

2. The structure of claim 1 wherein said one frame side is a frame top.

3. The structure of claim 2 wherein there are provided a plurality of said heat exchangers arranged in a stack in said frame with gasket means between each adjacent pair of heat exchangers, said stack being at right angles to said movable frame top.

4. The structure of claim 2 wherein said frame top is a part of a duct with said clamp means also clamping said frame top to said duct through a fluid sealing gasket arranged between said frame top and said housing whereby release of the top by the clamp means also releases said duct gasket.

5. The structure of claim 1 wherein one of said frame sides that is adjacent to said clamp means is provided with a hinge mounting for outward movement when said clamp means is released to release the adjacent side of said heat exchanger.

6. The structure of claim 1 wherein said clamp means comprises a toggle joint clamp mounted on one of said frame sides and engaging an adjacent portion of said frame top.

7. The structure of claim 6 wherein said one frame side that is adjacent to said clamp means is provided with a hinge mounting for outward movement when said clamp means is released to release the adjacent side of said heat exchanger.

8. The structure of claim 1 wherein said heat exchanger is provided with parallel transverse passages with adjacent passages being at right angles to each other for flow through said passages of two separate heat exchange fluids.

9. The structure of claim 1 wherein one of said frame sides that is adjacent to said clamp means is provided with a hinge mounting for outward movement when said clamp means is released to release the adjacent side of said heat exchanger, and said clamp means comprises a toggle joint clamp mounted on one of said frame sides and engaging an adjacent portion of said frame top.

10. The structure of claim 1 wherein said one frame side is a frame top, there are provided a plurality of said heat exchangers arranged in a stack in said frame with gasket means between each adjacent pair of heat exchangers, said stack being at right angles to said movable frame top, and said frame top is a part of a duct with said clamp means also clamping said frame top to said duct through a fluid sealing gasket arranged between said frame top and said housing whereby release of the top by the clamp means also releases said duct gasket.

* * * * *